US011359367B2

(12) United States Patent
Wiegrink

(10) Patent No.: US 11,359,367 B2
(45) Date of Patent: Jun. 14, 2022

(54) JOINT FILLING PROFILE

(71) Applicant: SK Wiegrink Beteiligungs GmbH, Bocholt (DE)

(72) Inventor: Stefan Wiegrink, Bocholt (DE)

(73) Assignee: SK Wiegrink Beteiligungs GmbH, Bocholt (DE)

( * ) Notice: Subject to any disclaimer, the term of this patent is extended or adjusted under 35 U.S.C. 154(b) by 30 days.

(21) Appl. No.: 16/782,226

(22) Filed: Feb. 5, 2020

(65) Prior Publication Data

US 2020/0277779 A1 Sep. 3, 2020

(30) Foreign Application Priority Data

Feb. 28, 2019 (DE) ..... 20 2019 101 140.8

(51) Int. Cl.

| | |
|---|---|
| ***E04B 1/68*** | (2006.01) |
| ***E01D 19/06*** | (2006.01) |
| ***E01C 11/04*** | (2006.01) |
| ***E01C 11/02*** | (2006.01) |
| ***E04F 15/02*** | (2006.01) |
| ***E04F 15/14*** | (2006.01) |

(52) U.S. Cl.

CPC ..... *E04B 1/6804* (2013.01); *E01C 11/02* (2013.01); *E01C 11/04* (2013.01); *E01D 19/06* (2013.01); *E01D 19/065* (2013.01); *E04B 1/6801* (2013.01); *E04F 15/02011* (2013.01); *E04F 15/02016* (2013.01); *E04F 15/02033* (2013.01); *E04F 15/14* (2013.01); *E04F 15/142* (2013.01)

(58) Field of Classification Search

CPC ..... E04B 1/6801; E04B 1/6804; E04B 1/68; E01C 11/02; E01C 11/04; E01D 19/06; E01D 19/065; E04F 15/02011; E04F 15/02016; E04F 15/02033; E04F 15/14; E04F 15/142

See application file for complete search history.

(56) References Cited

U.S. PATENT DOCUMENTS 2,184,148 A * 12/1939 Malcom ..... E01C 11/14 404/55
3,447,430 A * 6/1969 Gausepohl ..... E04B 1/6804 404/69

(Continued)

FOREIGN PATENT DOCUMENTS

AT 375 984 B 9/1984
DE 19537444 A1 * 4/1997 ..... E04B 1/6807

(Continued)

*Primary Examiner* — Jessie T Fonseca
(74) *Attorney, Agent, or Firm* — Harness, Dickey & Pierce, P.L.C.

(57) ABSTRACT

A joint filling profile for forming a joint sealing between floor slabs includes a vertical leg projecting into the joint and a profile body formed from a joint sealing compound and located in a joint widening. The vertical leg and the profile body are separated from each other with the interposition of a first separating material, wherein at least one second separating material is arranged between the vertical leg and the profile body and/or at least one reinforcing mat is arranged within the profile body. The second separating material and/or the reinforcing mat are arranged in such a way that they overlap with the first separating material at least in regions.

15 Claims, 3 Drawing Sheets

(56) References Cited

Figure 1:
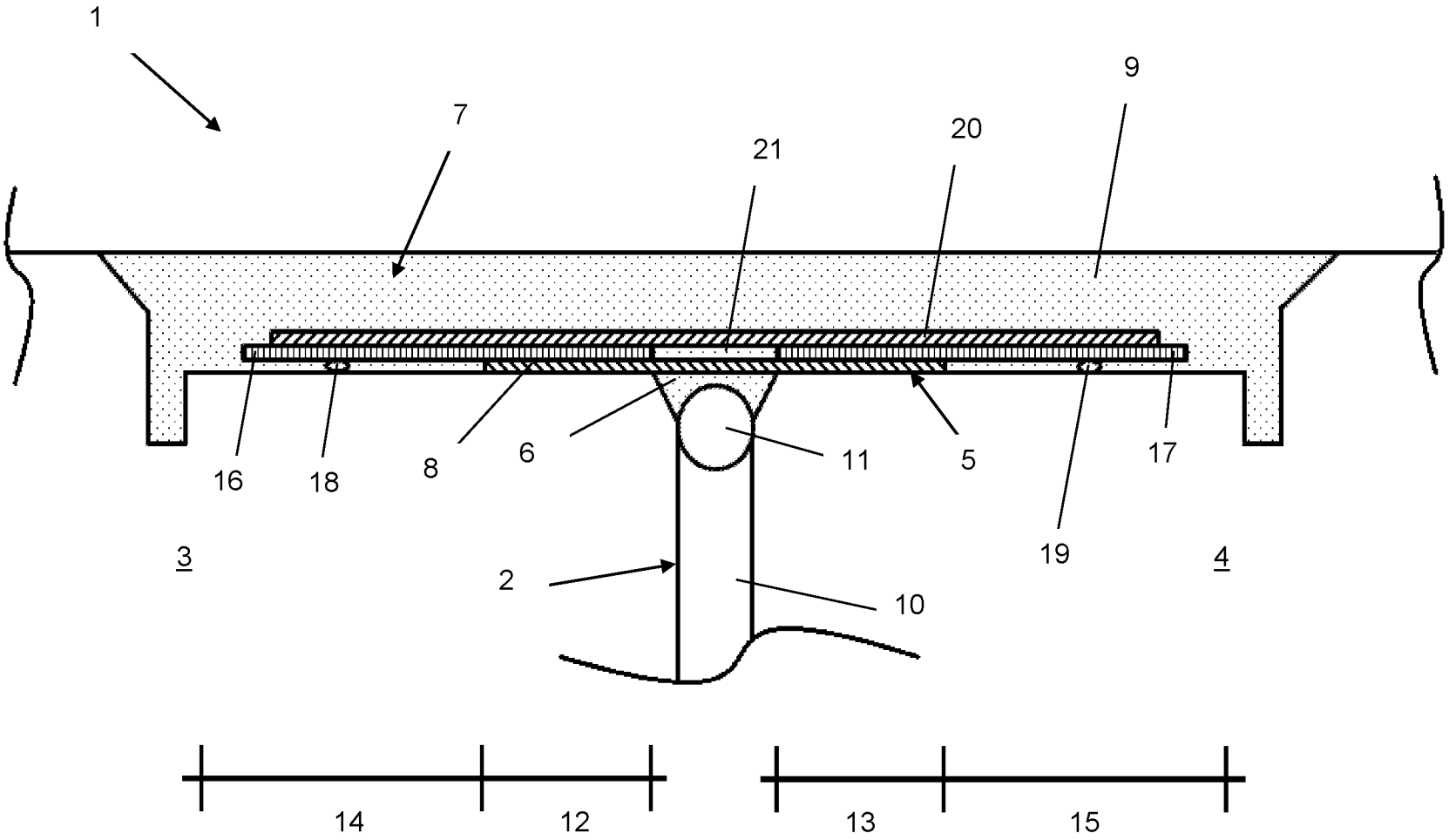

U.S. PATENT DOCUMENTS 3,827,204 A * 8/1974 Walters ..... E04B 1/6801 52/396.04
4,063,840 A * 12/1977 Fordyce ..... E01D 19/06 404/69
4,601,604 A * 7/1986 Clark ..... E01D 19/06 404/66
4,784,516 A * 11/1988 Cox ..... E01C 11/10 14/73.1
5,024,554 A * 6/1991 Benneyworth ..... E01D 19/06 404/47
5,082,394 A * 1/1992 George ..... E01D 19/06 404/57
5,171,100 A * 12/1992 Bergstedt ..... E01C 11/106 403/225
5,513,927 A * 5/1996 Baker ..... E01D 19/06 404/47
8,790,038 B2 * 7/2014 Stachowicz ..... E01D 19/06 404/47
8,826,481 B1 * 9/2014 Haydu ..... E01D 19/083 14/73.5
10,851,897 B2 * 12/2020 Robinson ..... B32B 5/18
2002/0069602 A1 * 6/2002 Blanchet ..... E04H 9/14 52/600
2003/0126817 A1 * 7/2003 Gleeson ..... C09J 133/20 52/460
2016/0348322 A1 * 12/2016 Rangoni ..... E01B 27/04
2017/0321432 A1 * 11/2017 Wiegrink ..... E04F 15/02016
2018/0010330 A1 * 1/2018 Hamilton ..... E01C 11/126
2018/0127931 A1 * 5/2018 Pascetta ..... E01D 19/067
2019/0242070 A1 * 8/2019 Robinson ..... E04B 1/6801

FOREIGN PATENT DOCUMENTS

DE 692 22 073 T2 2/1998
DE 10111466 A1 * 9/2002 ..... E04B 1/6804
DE 10002866 B4 2/2008
DE 102015118223 A1 4/2017
DE 202016102430 U1 * 8/2017 ..... E04F 15/14
EP 2098651 A2 * 9/2009 ..... E04B 1/6804
EP 2098651 A2 9/2009
EP 3241953 A1 11/2017
FR 2308747 A1 * 11/1976 ..... E01D 19/06
WO WO-0011268 A1 * 3/2000 ..... E01C 5/003
WO WO-2007053119 A1 5/2007

* cited by examiner

JOINT FILLING PROFILE

CROSS-REFERENCE TO RELATED APPLICATIONS

This application claims the benefit and priority of German Application No. 2020191011408, filed Feb. 28, 2019. The entire disclosure of the above application is incorporated herein by reference.

FIELD

The invention relates to a joint filling profile for forming a joint sealing between floor slabs, with a vertical leg projecting into the joint and a profile body formed from a joint sealing compound and located in a joint widening.

BACKGROUND

Joint filling profiles for forming a joint sealing are well known from prior art. For example, DE 100 02 866 B4 and EP 2 098 651 A2 disclose joint filling profiles of the type described.

Typically, the joint provided between two floor slabs is sealed by means of a so-called joint sealing compound. This can be done in a simple way by filling the joint with a joint sealing compound. However, joint profiles formed in such a simple way only have a limited service life, which is a disadvantage, especially when the joint profiles are exposed to corresponding loads, as is often the case in industrial applications.

In order to provide a joint profile that can also withstand higher loads and is even suitable for ventilation applications, DE 100 02 866 B4 has proposed a design in which an essentially horizontally extending joint widening is made at the mutually facing free upper edges of adjacent floor slabs, and the joint is filled with a joint sealing compound as far as the joint widening in a manner flush with the surface. Vertical recesses are formed in the end edge area of the joint widening, so-called anchorage cuts, which are engaged by the profile body formed from the joint sealing compound.

The joint filling profile known from DE 100 02 866 B4 has proven itself in everyday use. With regard to some applications, however, it has turned out that due to the direct connection between the joint sealing compound and the floor slabs, the joint filling profile may break away from the floor slabs due to expansion. This problem occurs increasingly under corresponding mechanical and/or thermal loads and weighs more heavily the larger the joint width or the joint widening is constructively designed.

In order to avoid undesirable detachment of the joint sealing compound from the floor slabs, EP 2 098 651 A1 proposes that each of the two floor slabs should have a region in which no direct connection to the floor slabs is provided. According to this construction, each of the floor slabs provides a region adjacent to the vertical leg of the joint filling profile which is chemically and/or mechanically designed in such a manner that the joint sealing compound introduced into the joint and the joint widening does not form a direct connection with the floor slab in this region. Advantageously, it is hereby achieved that the joint filling profile has an increased expansion capacity without the risk of becoming detached from the substrate, since in regions where there is no direct connection between the joint sealing compound on the one hand and the floor slabs on the other, expansion of the material forming the joint sealing compound is permitted, because in these regions only the material is expanded, without being hindered by adhesion to the substrate. In this respect, joint filling profiles according to EP 2 098 651 A2 can withstand higher mechanical and/or thermal loads and this with a significantly reduced risk of unintentional detachment from the substrate.

Although the joint filling profile pre-known from EP 2 098 651 A2 has already produced a significant improvement, this construction is also not free of disadvantages. For example, it has turned out to be problematic that the different material thicknesses in the region of the vertical leg on the one hand and the profile body on the other hand can lead to crack formation in the transition area between the vertical leg and the profile body under corresponding expansion loads. Such crack formation can in turn lead to the unintentional detachment of the joint filling profile from the substrate. Practical experience has also shown that in load situations in the areas adjacent to the vertical leg, where there is no direct connection between the joint sealing compound and the floor slabs, lens-shaped depressions may occur. This is because in these areas an expansion of the material is permitted due to the lack of connection to the substrate, but not in the adjacent areas. This results in uneven loading of the joint filling profile, which also has a negative effect on the service life of the overall structure.

In order to avoid cracking in the area of the vertical leg, EP 3 241 953 A1 proposes that the vertical leg and the profile body be separated from each other with the interposition of a separating material, in particular a metal foil. The separation of the vertical leg and the profile body has the advantage that undesirable crack formation is also avoided in the transition area between the vertical leg and the profile body, because in the absence of a one-piece design there will be no different material thicknesses, so that a different expansion behavior due to different material thicknesses is prevented. Although this design has proven itself in practice, there is an obvious need for improvement. It has turned out that the profile body arranged in the joint widening tends to vertical cracking at the respective ends of the metal foil.

SUMMARY

The invention is thus based on the problem of providing a joint filling profile that eliminates the aforementioned disadvantages.

To solve the problem, the invention proposes a joint filling profile for forming a joint sealing between floor slabs, with a vertical leg projecting into the joint and a profile body formed from a joint sealing compound and located in a joint widening, the vertical leg and the profile body being separated from each other with the interposition of a separating material, at least one second separating material being arranged between the vertical leg and the profile body and/or at least one reinforcing mat being arranged within the profile body, the second separating material and/or the reinforcing mat being arranged overlapping with the first separating material at least in regions.

It has been shown that each of the embodiments claimed according to the invention is capable of eliminating the disadvantages existing in prior art by itself and in synergetic combination. In particular, the double-layer arrangement of two separating materials, which are preferably made of metal foils, in particular aluminum foils, can achieve further decoupling of the profile body and the vertical web compared to prior art. This is particularly true because the first separating material is only in contact with the vertical web, but not with the profile body. On the other hand, the second separating material is only in contact with the profile body, but not with the vertical web. In the case of expansion movements, the two separating materials, especially in the case of metal foils, can slide completely freely over each other. In contrast to prior art, where only one separating material is provided and where adhesion can occur on both sides, adhesions of joint sealing compound to the foils have no consequences. As an alternative material for the second separating material, not only a metal foil but also a nonwoven has proven to be effective. This is because, on the one hand, it is impermeable to the joint sealing compound and, on the other hand, it can slide over the first separating material, which is formed as a metal foil, especially aluminum foil, with particularly low frictional resistance. According to the invention, the two separating materials can therefore be made of the same material or of different materials.

Likewise, the embodiment according to the invention, comprising at least one reinforcing mat, advantageously achieves that cracking which disadvantageously occurs in prior art in the portions not covered by the first separating material is advantageously prevented. Any material stresses occurring in these portions between the floor slabs and the profile body are completely absorbed by the at least one reinforcing mat. With regard to its geometric design, the profile body preferably has at least one first portion adjacent to the vertical web. A second portion of the profile body adjoins the first portion. The separating material is arranged exclusively between the vertical web and the profile body and in the area of the at least one first portion. Preferably, the second separating material is arranged in the direction of the profile body above the first separating material and also exclusively between the vertical web and the profile body and in the region of the at least one first portion.

In accordance with a particularly preferred embodiment, the profile body has two first portions which in cross-section are formed opposite one another on both sides adjacent to the vertical web. Preferably, a second portion of the profile body adjoins a first portion. The profile body can be axially symmetrical.

With regard to the reinforcing mat, it is preferred that it is formed like a lattice of longitudinal and transverse struts. Thus the forces acting at the junction points of the respective struts are distributed to the entire lattice. Furthermore, it is preferred that continuous openings for the joint sealing compound are formed between the longitudinal and transverse struts. This ensures that the joint sealing compound of the profile body is in contact with the respective floor slabs in the second portions. A separate separation between the profile body and the floor slabs, as proposed in EP 2 098 651 A1, is no longer necessary due to the design according to the invention, as the separating material completely serves this purpose, too. The reinforcing mat according to the invention serves the purpose of absorbing the additional stresses. In this context, it has proved to be particularly advantageous to form the rim of the end of the reinforcing mat extending beyond the separating material with a contour changing in the longitudinal direction. Such a variable contour is in particular a wavy contour, a zigzag contour or a fringe-like contour. In the fringe-like structure, alternating longitudinal struts and cross struts form the respective end of the reinforcing mat. Especially the fringe-like contour has proven to be particularly advantageous.

The reinforcing mat can basically be made of any material that is suitable for absorbing the stresses that occur. In particular, mats made of metal, especially metal wire, or plastic are preferred. Particularly preferably, the reinforcing mats are made of plastic. This is because plastic, in addition to its known material properties, interacts especially well with the joint sealing compound, which is preferably made of an elastic polymer resin, in terms of force. In synergetic interaction, this leads to particularly good stress conduction between the profile body and the reinforcing mat.

According to a preferred feature of the invention, a further reinforcing mat is provided. In this configuration, the first reinforcing mat extends over the first and second portions extending on one side of the joint. The second reinforcing mat, on the other hand, extends over the first and second portions extending on the other side of the joint. This prevents the formation of cracks over the entire profile body. In particular, it is provided that the reinforcing mats are arranged leaving a gap aligned with the joint 2 in its height direction. As a result, the stress absorption is adapted to the axially symmetrical design of the joint filling profile. Both areas separated from each other by the mirror axis thus have a separate reinforcing mat. Different stresses in the respective areas can thus be absorbed individually. In this context, it has proved to be particularly advantageous to select the width of the gap so that it corresponds to the width of the joint.

According to the invention, the joint filling profile consisting of the vertical leg and the profile body is not a one-piece design. According to the invention, it is rather provided to separate the vertical leg from the profile body by separating the vertical leg and the profile body with the interposition of a separating material. It is intended to form the joint filling profile by first filling the joint so that the vertical leg of the later joint filling profile is formed.

The vertical leg formed in this way is then provided with a separating material on its upper side facing the joint widening. This can be done mechanically or chemically, although the formation of a mechanical separation by inserting an intermediate layer is preferred. For example, a metal foil, in particular an aluminum foil, can serve as a mechanical separating layer, which has the advantage that there are no thermal restrictions with regard to the use and processing of corresponding joint sealing compounds.

The profile body is then formed from a sealing compound, the profile body being separated from the vertical leg due to the previously applied separating material. Therefore, there is no direct connection between the vertical leg and the profile body after the joint filling profile has been formed.

The separation of the vertical leg and the profile body in accordance with the invention has the essential advantage that undesirable crack formation is also avoided in the transition area between the vertical leg and the profile body. In the absence of a one-piece design, there will be no different material thicknesses, so that a different expansion behavior due to different material thicknesses is prevented. This means that unwanted detachment phenomena, in particular edge detachment, can be avoided even more effectively, resulting in an increased service life.

According to a further feature of the invention, in a first portion adjacent to the joint, the profile body rests on the associated floor slab in a connection-free manner, with the interposition of a separating material. According to this further development, there is therefore not only no direct connection between the profile body and the vertical web, but also between the profile body and the corresponding floor slab, to be precise, in a first portion of the profile body which is formed adjacent to the joint. Therefore, it is intended that the profile body has no direct connection to the substrate in an area which extends over a first portion of the first floor slab, the vertical leg and another first portion with respect to the other floor slab. This configuration allows the joint filling profile to perform expansion work to compensate for mechanical and/or thermal loads in an advantageous manner, without the risk of tearing and/or detachment, due to the lack of direct connection between the profile body and the substrate in the area described above. In particular, this is due to the lack of a one-piece design between the profile body and the vertical leg, since the profile body can expand in both the horizontal and vertical directions independently of the vertical leg, so that the ability of the profile body to expand is not affected by the vertical leg. Lens effects, i.e. constrictions caused by elongation, which occur in a detrimental way in designs previously known from prior art, can thus be reduced or even prevented. In addition, there is no danger of the profile body detaching from the associated floor slabs and/or from the vertical leg in the specified area.

According to a further feature of the invention it is provided that a large number of reinforcements are embedded in the profile body, which are arranged one behind the other in the longitudinal direction of the joint. The purpose of the reinforcements is to prevent the profile body from bulging or buckling in the area where there is no direct connection with the substrate in the event of expansion. The reinforcement therefore ensures that the profile body, despite the aforementioned elasticity, is essentially plane-parallel to the adjacent floor slabs, even under load.

According to a further feature of the invention it is provided that a reinforcement has a guide body on the one hand and a reinforcing element on the other hand, the reinforcing element being displaceable relative to the guide body. In the final assembled state, the guide body accommodates the reinforcing element so that there is no direct connection between the joint sealing compound of the profile body and the reinforcing element. The reinforcing element therefore does not impede the elasticity of the profile body. Rather, due to the relative displacement of the reinforcing element in relation to the guide body, it is possible for the reinforcing element to follow the movements of the profile body. However, the guide body is also stretchable, so that it does not prevent the profile body from stretching either.

According to a further feature of the invention, the guide body is a sleeve, and the reinforcing element may, for example, be a rod, in particular a metal rod. It is provided that in the final assembled state, the rod is received in a longitudinally displaceable manner by the sleeve, the sleeve having a longitudinal extension exceeding the longitudinal extension of the rod. This ensures that in the event of elongation of the profile body, the rod can move accordingly within the sleeve and is not restricted in movement by the sleeve. Due to the fact that the sleeve is longer in the longitudinal direction than the rod, the rod can move within the sleeve in the case of expansion, so that the expansion movement of the profile body is not blocked by the rod that serves as a reinforcing element.

In accordance with a preferred design of the invention, it is provided for the reinforcing mats to rest on the floor slabs in the second portions with a spacer interposed. It is also preferable that the reinforcing mats each rest on the separating material in the first portions. This ensures that the reinforcing mats are aligned horizontally, i.e. parallel to the floor slabs in the joint widening. This results in a particularly homogeneous stress absorption on the part of the reinforcing mats.

Another feature of the invention provides that the reinforcement rests on the reinforcing mats. This means that it is supported on the spacers with the reinforcing mats arranged in-between and can thus be positioned precisely in the joint widening. In terms of stress absorption, it has proved to be particularly advantageous if the reinforcement extends as far as the second portions, but the connecting mats extend beyond the reinforcement in the second portions.

In accordance with another feature of the invention, the profile body is axially symmetrical and has two first portions adjacent to the joint, each of which is followed by a second portion. There is no direct connection between the profile body and the substrate in the area of the joint and the two first portions. Such a direct connection is formed in the external second portions.

Accordingly, a further feature of the invention provides for the separating material to extend in the area of the joint and the two first portions adjacent thereto. This creates a continuous area that extends from the first portion of the first floor slab through the joint to the first portion of the second floor slab, where there is no direct connection between the profile body and the substrate.

According to a further feature of the invention, it is provided that the vertical leg and/or the profile body is/are temperature-resistant at least in portions up to a temperature of 60° C., preferably up to a temperature of 70° C., and even more preferably up to a temperature of 80° C.

According to this proposal, the joint filling profile is temperature resistant at least in portions. The joint filling profile is therefore also suitable for use in areas that are exposed to elevated temperatures as intended. In this context, the floor areas of industrial plants which are used for the installation of temperature emitting machines, furnaces and/or the like should be mentioned in particular.

In this context, a further feature of the invention provides that the sealing compound forming the vertical leg and/or the profile body is formed from a material which is thermally stable up to 60° C., preferably from a material which is thermally stable up to 70° C., and even more preferably from a material which is thermally stable up to 80° C. Preferably, a thermally stable plastic material is used in this context, which is introduced into the joint and/or the joint widening in the liquid state and is thermally stable up to the specified temperatures after curing. Alternatively, it can be provided that the vertical leg and/or the profile body are made of a thermally non-stable material and a coating is applied to cover the top of the profile body which is thermally stable up to the specified temperatures. It may also be provided that the vertical leg and the profile body are made of different materials, for example the vertical leg of a thermally non-stable material and the profile body of a thermally stable material.

According to a further alternative it can be provided that a granule of a thermally stable material is added to the sealing compound. Such a granule can be stone materials and/or graphite, for example.

According to a further feature of the invention it is provided that the sealing compound forming the vertical leg and/or the profile body includes particles that change their color as a result of physical and/or chemical influences.

The color change of the particles serves in an advantageous way for the user to be able to carry out a visual inspection of the joint filling profile designed in accordance with the invention. Physical and/or chemical influencing factors which can lead to a color change of the particles added to the sealing compound are, for example, mechanical pressure, ageing processes, effects of chemical substances such as acid and/or the like. It is particularly preferable to add particles to the sealing compound which change their color over time, i.e. over the service life of the joint filling profile according to the invention. The user can easily determine that the manufacturer's guaranteed service life of the joint filling profile has been achieved, which is why it must be replaced to ensure functional reliability. A color change as a result of excessive mechanical stress is also advantageous, as the joint filling profile can be irreversibly deformed, particularly as a result of excessive pressure loads. The actually desired functional safety can then no longer be guaranteed under certain circumstances, which is visually indicated to the user by a color change in the joint filling profile. The same applies to chemical substances. These can also lead to damage to the joint filling profile, which is why it is advantageous that a color change can indicate to a user that the joint filling profile has been exposed to corresponding chemical substances such as acids.

According to a further feature of the invention it is provided that a signal line is embedded in the profile body and/or the vertical leg. Such a signal line may be an optical fiber or a live conductor.

Such a signal line proves to be advantageous for several reasons. It can, for example, be used as a means for counting crossings. This can be done, for example, by permanently applying a signal to the signal line which changes as a result of a pressure load, i.e. in the event driving over it. This signal change is detected by a corresponding receiver unit. In this way, the number of crossings can be determined, whereby it is preferred that when a pre-settable number of crossings is reached, an indication is given which informs the user that a number of crossings guaranteed by the manufacturer, for example, has been reached.

The signal line can also be used advantageously as a crack warning device. In the event of crack formation, the signal line is exposed and/or destroyed. This can be detected and displayed to the user. In order to enable the most effective crack warning, a plurality of signal lines is preferably used, if necessary also in the design of a mat of signal lines. Such a mat can also serve as a separating material in the sense already explained above.

According to a further feature of the invention a moisture sensor is provided. Such a moisture sensor can be embedded in the sealing compound of the joint filling profile and/or inserted in the joint and/or the joint widening before the vertical leg and/or the profile body is formed. In particular, the moisture sensor serves to detect water that has penetrated the joint filling profile, so that in the event of detection, a corresponding output can be sent to the user. Basically, the joint filling profile designed according to the invention is watertight and also lies against the corresponding floor slabs in a watertight manner. In the event of the moisture sensor being activated, this means that the joint filling profile is destroyed at least in portions and/or shows cracks through which water has penetrated. The moisture sensor therefore serves to detect any damage to the joint filling profile at an early stage.

According to a further feature of the invention, a light strip embedded in the joint filling profile is provided. In emergency situations in particular, such a light strip is used to provide a route and/or to mark escape routes. In this context, it is preferable to connect the light strip to an appropriate emergency system using communication technology, so that the light strip can in fact only be put into operation in an emergency situation.

According to a further feature of the invention, the joint filling profile is characterized by an embedded active substance which is fire retardant, heat-insulating and/or releases an agent, such as a coolant, under the effect of heat.

A fire-retardant active substance can, for example, be formed by a suitable mortar, stone materials and/or the like. Mineral fiber materials, rock wool or the like may be provided as heat-insulating active substances. An active substance which releases an agent under the effect of heat can in particular be a material which foams under the effect of heat or a hydrate which releases water under the effect of heat. Alternatively, an active substance may also be provided which swells under the influence of heat.

The embedding of an active substance of the aforementioned type is intended in particular for joint filling profiles which are formed beneath room closures, such as doors or gates. Particular preference should be given to active substances that swell under the influence of heat, as this ensures that the gap which is provided between the room closure and the joint filling profile during use as intended is closed by the swollen joint filling profile. This not only provides protection against fire flashover, but also against the unintentional spread of smoke.

An active substance swelling under the influence of heat also has the advantage that a liquid retention volume is built up, namely by the fact that the swollen joint filling profile forms a barrier to escaping liquids, either to protect against an inflow into a room or against an outflow from a room.

According to a further feature of the invention it is provided that an active substance of the aforementioned type is part of a strip or cord element. Where provided, such an element can be easily embedded in the joint filling profile. It is preferable to embed such a strip element in the profile body, i.e. as close to the surface as possible. If the active substance is one that swells under the influence of heat, the joint filling profile tears open in the event of swelling and a barrier forms above the joint filling profile corresponding to the installation path of the strip or cord element.

The invention also proposes a method for producing a joint sealing between floor slabs, in which a substantially horizontally extending joint widening is made at the mutually facing free upper edges of adjacent floor slabs, in which the joint is filled flush with the upper surface of the bottom of the joint widening, in which the material filling the joint is provided on the upper side with a separating material, and in which a second separating material and/or a reinforcing mat is placed on the first separating material, the joint widening being filled with joint sealing compound flush with the surface of the floor slabs.

Furthermore, it is preferably provided that a reinforcement is inserted into the joint widening.

The result of the method carried out as described above is a joint filling profile of the type described above, which also achieves the advantages described above.

DRAWINGS

Figure 2:
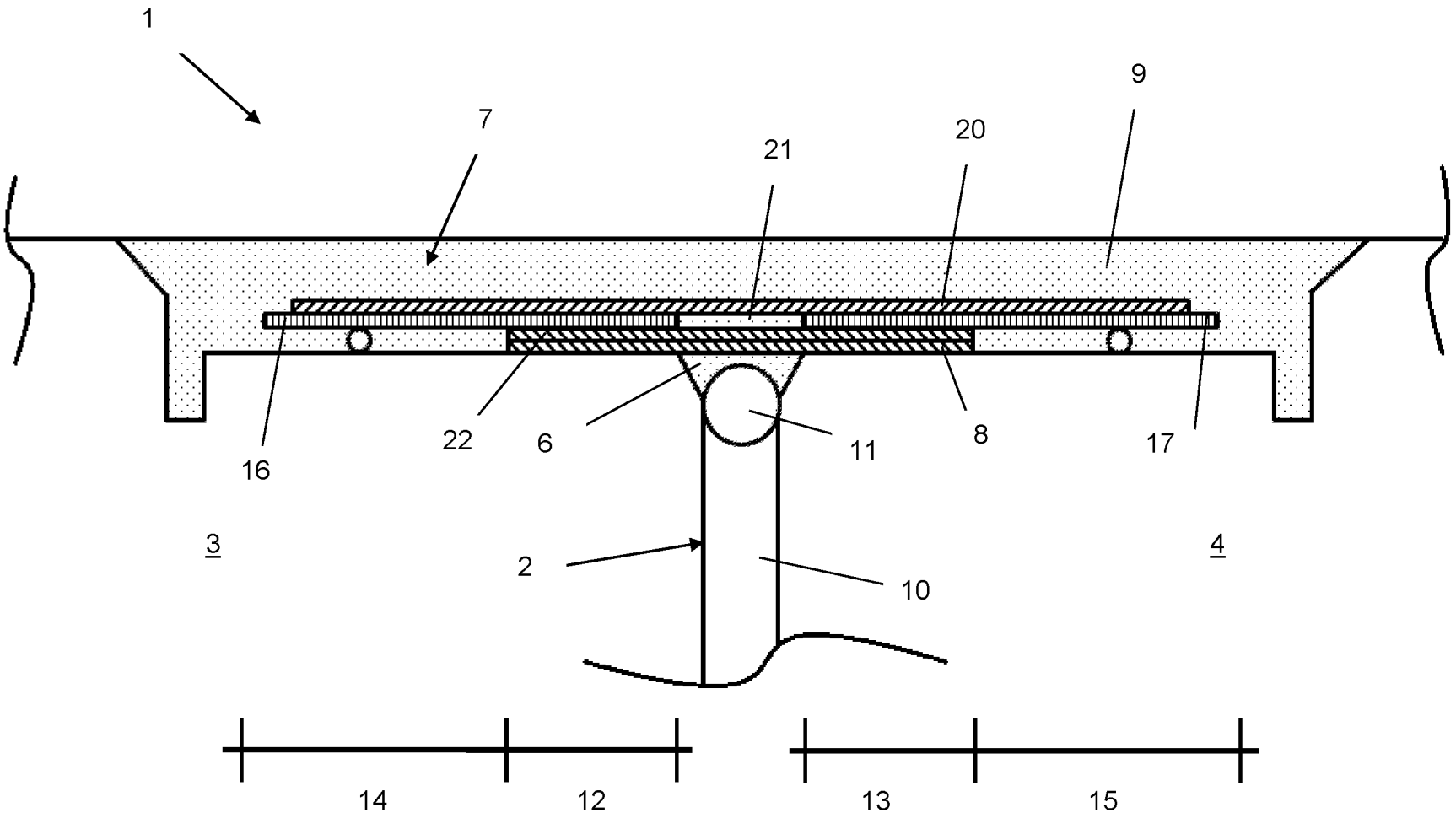
Figure 3:
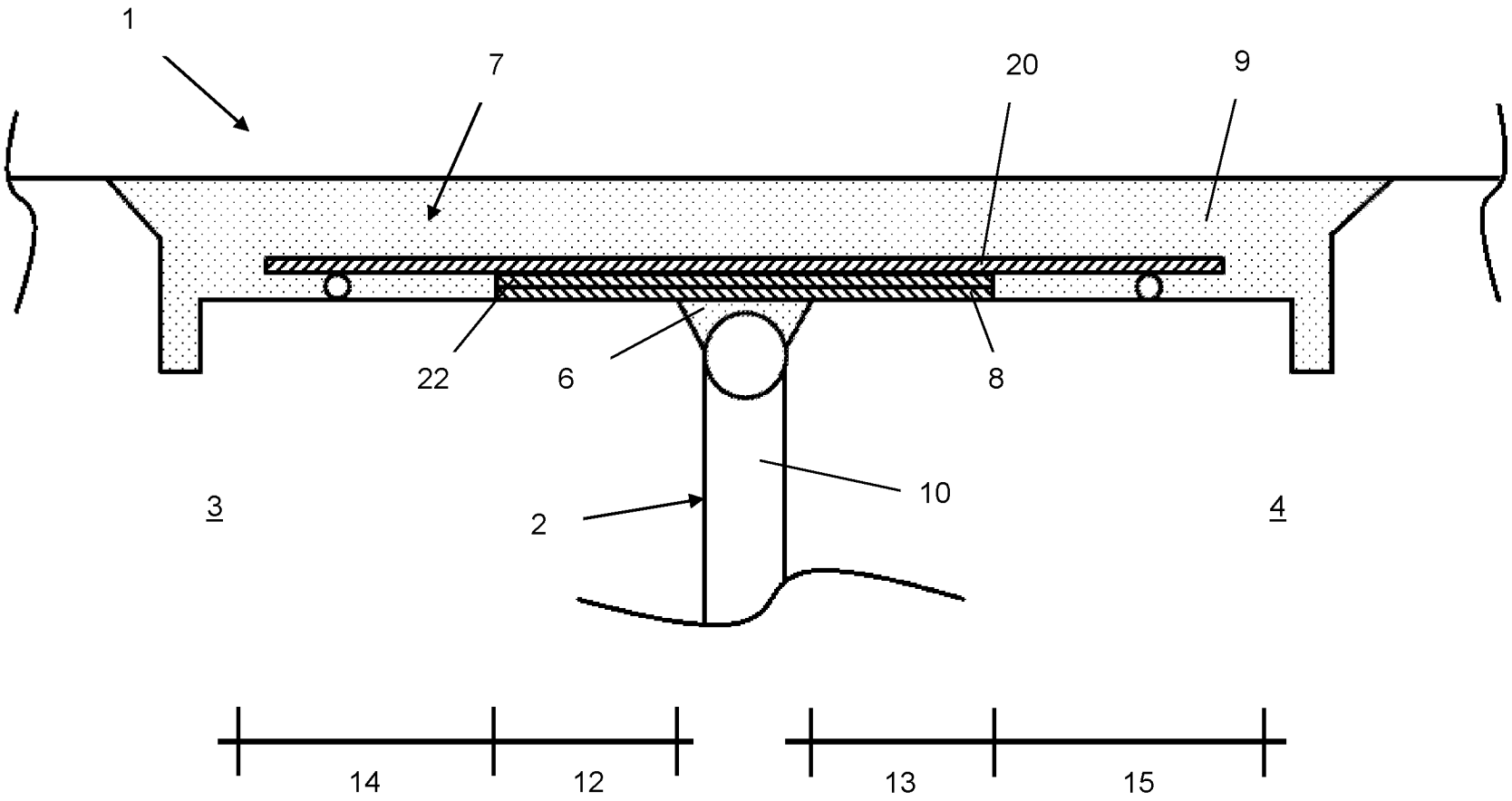

Further features and advantages of the invention will become apparent from the following description with reference to the drawings in which it is shown by FIG. 1 a schematic sectional view of a first joint filling profile according to the invention;

FIG. 2 a schematic sectional view of a second joint filling profile according to the invention;

FIG. 3 a schematic sectional view of a third joint filling profile according to the invention.

DETAILED DESCRIPTION

In order to achieve the effect according to the invention, it is only necessary that either a second separating material or a reinforcing mat are provided in addition to the to the first separating material in the manner according to the invention. The combination of both features and all the other preferred features are optional, but contribute to the further improvement of the invention both on their own and in synergetic combination.

FIG. 1 shows a joint filling profile 1 according to the invention. A joint 2 is left between two adjacent floor slabs 3 and 4, for example an expansion joint. This usually results from building regulations or other necessities. In the area of the joint 2, a filling material 10, e.g. a form insert, and a round cord 11 are arranged in a manner known per se in order to prevent three-flank adhesion. Otherwise, the joint sealing compound would connect the floor slabs 3 and 4 as well as the underlying ground with each other.

In the area of the mutually facing free upper edges of the floor slabs 3 and 4, an essentially horizontally extending joint widening 5 is formed, which defines rectangular grooves on the outside which essentially run parallel to the joint 2.

To form the joint filling profile 1, the joint 2 is filled with joint sealing compound 9 as far as the joint widening 5 and flush with the surface. The joint filling profile 1 has a vertical leg 6 arranged in the joint 2 and a profile body 7 arranged in the joint widening 5. The vertical leg 6 and the profile body 7 of the joint filling profile 1 are not formed in one piece, but rather separated from each other. This is achieved by arranging a separating material 8 between the vertical leg 6 and the profile body 7. The separating material 8 can, for example, be a mechanically acting intermediate layer, for example a metal foil, in particular an aluminum foil. In the design example shown, the vertical leg 6 and the profile body 7 are formed from a joint sealing compound 9. The same sealing compound 9 is preferably used for both the vertical leg 9 and the profile body 7. Alternatively, the vertical leg 6 can be designed as a compression block made of an elastic material such as a foam material. In any case, however, it is provided that the vertical leg 6 and the profile body 7 are separated from each other by means of the separating material 8, so that there is no direct connection between the profile body 7 and the vertical leg 6.

For each base plate 3 or 4, the profile body 7 provides a first portion 12 or 13 adjacent to the joint 2 or the vertical web 6, in which first portion 12 or 13 the profile body 7 rests on the associated base plate 3 or 4 in a connection-free manner with a separating material 8 in between. This creates a continuous area that extends over the first portion 12 formed in the area of the base plate 3, the joint 2 and the first portion 13 formed in the area of the base plate 4, in which there is no direct connection between the profile body 7 and the substrate.

The profile body has second portions 14 or 15 adjacent to the first portions 12 or 13. In the area of these portions 14 or 15 there is a third connection between the joint sealing compound 9 forming the profile body 7 and the substrate formed by the respective floor slabs 3 and 4.

Within the profile body 7, a reinforcing mat 16, 17 of lattice-like longitudinal and transverse struts is arranged on both sides of the joint 2 above the separating material 8 with reference to the image plane. The reinforcing mat 16 extends over both portions 12, 14. The reinforcing mat 17 extends over both portions 13, 15. The reinforcing mats 16, 17 are arranged leaving a gap 21 aligned with the joint 2 in height direction with respect to the image plane. The gap 21 is filled with joint sealing compound 9 as part of the profile body 7. The arrangement of the reinforcing mats 16, 17 according to the invention ensures that the crack formation in the portions 14, 15 adjacent to the separating material, which is a disadvantage in prior art, is prevented in an advantageous manner. Due to their lattice-like structure, the reinforcing mats 16, 17 have openings formed between longitudinal and transverse struts that are continuous for the joint sealing compound 9. In portions 14, 15, the reinforcing mats 16, 17 each rest on spacers 18, 19. Overall, this ensures that the joint sealing compound 9 of the profile body 7 in the portions 14, 15 is in contact with the respective floor slabs 3, 4. Each spacer 18 or 19 can have a bearing element extending in the longitudinal direction of the joint which is supported by supporting elements. The profile body 7 is thus largely free of stresses between the joint sealing compound 9 and the floor slabs 3, 4.

Furthermore, reinforcements in the form of plugs 20 are arranged inside the profile body 7. The reinforcements are optional in this as well as in the other embodiments according to FIGS. 1 to 3. With regard to the reinforcements, a large number of plugs 20 are provided, which are arranged one behind the other in the longitudinal direction of the joint 2. The plugs 20 are preferably positioned at equal distances adjacent to each other. Each plug 20 has a sleeve and a rod which is held by the sleeve. A sleeve is longer in its longitudinal extension than the associated rod, i.e. the longitudinal extension of the sleeve exceeds the longitudinal extension of the corresponding rod. This design makes it possible for the rod to move relative to the sleeve.

In the example shown, the two spacers 18, 19, which support the plug 20 at one end or at the other end, are used to position the plug 20 securely within the joint widening 5. In the present embodiment, the reinforcing mats 16, 17 are arranged between the plugs 20 and the spacers 18, 19. The plugs 20 rest on the reinforcing mats 16, 17 at least in the area of both sides.

It is further provided that the extension of the reinforcing mats 16, 17 at the ends of each of the portions 14, 15 exceeds the longitudinal extension of the plugs 20. It has been shown that this can prevent edge cracking at the end of the plugs.

To form the joint sealing, the filling material 10 and the round cord 12 are first introduced into joint 2. Then the vertical leg 6 is formed, in the example shown, by introducing the joint filling compound 9 into the joint 2, whereby the joint 2 is filled at least flush with the surface of the bottom of the joint widening 5. It cannot be excluded that part of the vertical leg 6 projects into the joint widening 5. Nevertheless, the vertical leg 6 and the profile body 7 are completely separated from each other by the separating material 8. The respective joint-side end of the reinforcing mats 16, 17 can rest on the part of the vertical leg 6 projecting into the joint widening 5, with the separating material 8 being interposed. It is preferable that the combined height of the part of the vertical leg 6 projecting into the joint widening 5 and of the separating material 8 corresponds to the height of the spacers 18, 19. This ensures that the reinforcing mats 16, 17 are aligned horizontally in the joint widening 5. This results in stress absorption on the part of the reinforcing mats 16, 17 which is particularly homogeneous.

Then the separating material 8 is introduced, which in the example shown extends over the joint 2 and the two first portions 12 and 13 of the floor slabs 3 and 4 respectively. The spacers 18 and 19 are then positioned within the joint widening 5, onto which the reinforcing mats 16, 17 are then placed. Thereafter, the plugs 20 are placed on the reinforcing mats 16, 17. Then the joint filling compound 9 is introduced into the joint widening 5 to form the profile body 7, with the joint widening 5 being filled with the joint sealing compound 9 so as to be flush with the surface of the floor slabs 3 and 4.

A particular advantage of the joint filling profile in accordance with the invention is that neither in the transition area between the profile body 7 and the vertical leg 6 nor in the overlap area of the separating material 8 and the reinforcing mats 16, 17 tearing or cracking can occur which would then lead to undesirable detachments. Furthermore, the connection-free design of the profile body 7 in the area of the first portions 12 and 13 and the joint 2 creates a comparatively large area in which the joint filling profile 1 can perform free expansion work to compensate for mechanical and/or thermal loads. Unwanted detachments and/or flank breaks are thus avoided. The vertical leg 6 does not stand in the way of such an elongation work either, since according to the invention there is no direct connection between the vertical leg 6 and the profile body 7.

FIG. 2 shows another embodiment of the invention in which, in addition to the first separating material 8, a second separating material 22 in the form of an aluminum foil is arranged between the vertical web 6 and the profile body 7. The separating material 22 lies directly on the first separating material 8. It is flush with the edges of the first separating material 8 in cross section.

Also shown are reinforcing mats 16, 17. The reinforcing mat 16 extends over both portions 12, 14. The reinforcing mat 17 extends over both portions 13, 15. The reinforcing mats 16, 17 are arranged leaving a gap 21 aligned with the joint 2 in the direction of height with respect to the image plane. The gap 21 is filled with joint sealing compound 9 as part of the profile body 7.

In the first portions 12, 13, the reinforcing mats 16, 17 rest directly on the second separating material 22.

In the area of the gap 21, the arrangement of the first and second separating materials 8, 22 on top of each other results in a double layer. In the first portion, on the other hand, the overlapping of the respective reinforcing mat 16, 17 with the double-layer separating material 8, 22 results in a three-layer structure. Due to the multiple layers in some areas, a particularly good force release and absorption within the joint filling profile 1 is achieved. It is therefore particularly insensitive to all possible causes of crack formation.

FIG. 3 shows a further embodiment of the invention without reinforcing mats 16, 17, in which, in addition to the first separating material 8, a second separating material 22 in the form of an aluminum foil is arranged between the vertical web 6 and the profile body 7. The separating material 22 lies directly on the first separating material 8. It terminates flush with the edges of the first separating material 8 in cross section.

In this embodiment, the reinforcement 20 in the first portions 12, 13 rests directly on the second separating material 22.

In particular, the double-layer arrangement of the two separating materials 8, 22 allows a more extensive decoupling of the profile body and vertical web in terms of movement compared to the prior art. This is particularly because the first separating material 8 only has contact with the vertical web 6, but not with the profile body. On the other hand, the second separating material 22 only has contact with the profile body, but not with the vertical web. In the event of expansion movements, the two separating materials 8 and 22, which are designed as aluminum foils, can slide over each other completely freely and almost without frictional resistance. In contrast to prior art, in which only one separating material is provided and in which adhesion can take place on both sides, adhesions of joint sealing compound to the foils 8, 22 have no consequences.

What is claimed is:

1. A joint filling profile for forming a joint sealing between floor slabs comprising:

a vertical leg projecting into the joint and a profile body formed from a joint sealing compound and located in a joint widening, said vertical leg and profile body being separated from each other with the interposition of a first separating material, wherein at least a second separating material is arranged between the vertical leg and the profile body and that at least one reinforcing mat is arranged within the profile body, the second separating material and/or the reinforcing mat being arranged in such a way that they overlap with the first separating material at least in regions, wherein the reinforcing mat is formed from plastic.

2. The joint filling profile according to claim 1, wherein the first separating material and the second separating material are each formed from a metal foil.

3. The joint filling profile according to claim 1, wherein the profile body has at least one first portion adjacent to the vertical leg, a second portion of the profile body adjoining the first portion, and the first separating material being arranged exclusively between the vertical leg and the profile body and also in the region of the at least one first portion.

4. The joint filling profile according to claim 3, wherein also the second separating material is arranged exclusively between the vertical leg and the profile body and also between the at least one first portion and in the direction of the profile body above the first separating material.

5. The joint filling profile according to claim 3, wherein the reinforcing mat is arranged in such a way that it overlaps with the first and the second separating material in the region of the first portion and in the region of the second portion within the profile body.

6. The joint filling profile according to claim 1, wherein the reinforcing mat is formed from longitudinal and transverse struts.

7. The joint filling profile according to claim 6, wherein continuous openings for the joint filling compound are formed between the longitudinal and transverse struts.

8. The joint filling profile according to claim 1, wherein the profile body is formed axially symmetrically and has two first portions which in cross-section are formed opposite one another, on both sides adjacent to the vertical leg, wherein a second portion of the profile body respectively adjoins one of the first portions, wherein the first separating material and the second separating material are arranged exclusively between the vertical leg and the profile body and in the area of the two first portions, and wherein a further reinforcing mat is provided, each of the two reinforcing mats respectively extending over one of the first portions and the second portion.

9. The joint filling profile according to claim 8, wherein the reinforcing mats are spaced apart from each other leaving a gap aligned with the vertical web in a height direction thereof.

10. The joint filling profile according to claim 9, wherein the width of the gap corresponds to the width of the vertical web.

11. The joint filling profile according to claim 1, wherein the profile body in a first portion adjacent to the joint rests on an associated floor slab in a connection-free manner and with the interposition of the first separating material.

12. The joint filling profile according to claim 1, wherein a plurality of reinforcements arranged one behind the other in the longitudinal direction of the joint are embedded in the profile body.

13. The joint filling profile according to claim 8, wherein the reinforcing mats in the second portions rest on the floor slabs with the interposition of a respective spacer.

14. The joint filling profile according to claim 8, wherein the reinforcing mats in the first portions rest directly on the first or the second separating material, respectively.

15. The joint filling profile according to claim 12, wherein the reinforcements rest directly on reinforcing mats.

* * * * *